US010400492B2

(12) United States Patent
Pacini

(10) Patent No.: US 10,400,492 B2
(45) Date of Patent: Sep. 3, 2019

(54) HIDDEN HINGE

(71) Applicant: Fapim S.p.A., Altopascio (Lucca) (IT)

(72) Inventor: Sergio Pacini, Montecarlo (IT)

(73) Assignee: FAPIN S.P.A., Altopascio (Lucca) (IT)

( * ) Notice: Subject to any disclaimer, the term of this patent is extended or adjusted under 35 U.S.C. 154(b) by 0 days.

(21) Appl. No.: 15/740,949

(22) PCT Filed: Jul. 12, 2016

(86) PCT No.: PCT/IB2016/054158
§ 371 (c)(1),
(2) Date: Dec. 29, 2017

(87) PCT Pub. No.: WO2017/009776
PCT Pub. Date: Jan. 19, 2017

(65) Prior Publication Data

US 2018/0187468 A1 Jul. 5, 2018

(30) Foreign Application Priority Data

Jul. 15, 2015 (IT) ..... 102015000034634

(51) Int. Cl.
*E05D 7/04* (2006.01)
*E05D 15/52* (2006.01)

(52) U.S. Cl.
CPC ..... *E05D 15/5211* (2013.01); *E05D 7/0415* (2013.01); *E05Y 2201/224* (2013.01); *E05Y 2600/12* (2013.01); *E05Y 2600/31* (2013.01); *E05Y 2900/148* (2013.01)

(58) Field of Classification Search
CPC ... E05D 7/0415; E05D 15/5211; E05D 3/186; E05D 7/081; E05D 7/0009; E05D 7/0018; E05D 7/0027; E05D 7/0045; E05D 7/0054
See application file for complete search history.

(56) References Cited

U.S. PATENT DOCUMENTS 3,690,035 A * 9/1972 Schindlauer ..... E05D 7/1005 49/192
3,867,790 A * 2/1975 Frank ..... E05D 15/5205 16/360
5,052,079 A * 10/1991 Vosskotter ..... E05D 15/32 16/367
10,072,450 B2 * 9/2018 Lambertini ..... E05D 7/0054
2009/0044377 A1 * 2/2009 Liang ..... E05D 7/0415 16/354

(Continued)

FOREIGN PATENT DOCUMENTS

EP 0704593 A1 4/1996
EP 1612356 A2 1/2006
EP 2708692 A2 1/2006

(Continued)

OTHER PUBLICATIONS

International Search Report and Written Opinion for International Application No. PCT/IB2016/054158 (10 Pages) (dated Nov. 14, 2016).

*Primary Examiner* — Jeffrey O'Brien
(74) *Attorney, Agent, or Firm* — Lucas & Mercanti, LLP

(57) ABSTRACT

The present invention relates to a hinge for windows having a sash hinged on a fixed frame; in particular, the hinge is of the hidden type, i.e. is mounted inside the jamb of the fixed frame, so that it is not visible when the sash is closed.

17 Claims, 7 Drawing Sheets

(56) References Cited

U.S. PATENT DOCUMENTS

| | | | | |
|---|---|---|---|---|
| 2017/0198509 | A1* | 7/2017 | Van Parys | E05D 3/186 |
| 2018/0002963 | A1* | 1/2018 | Lambertini | E05D 7/0054 |

FOREIGN PATENT DOCUMENTS

| | | | |
|---|---|---|---|
| EP | 1918498 | A1 | 5/2008 |
| EP | 2060716 | A1 | 5/2009 |
| EP | 2703587 | A2 | 3/2014 |
| EP | 2811092 | A2 | 12/2014 |

* cited by examiner

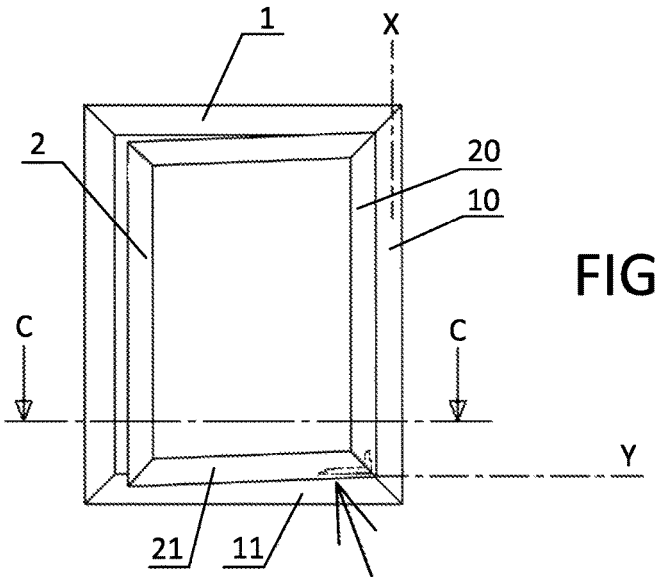
FIG. 1
FIG. 2
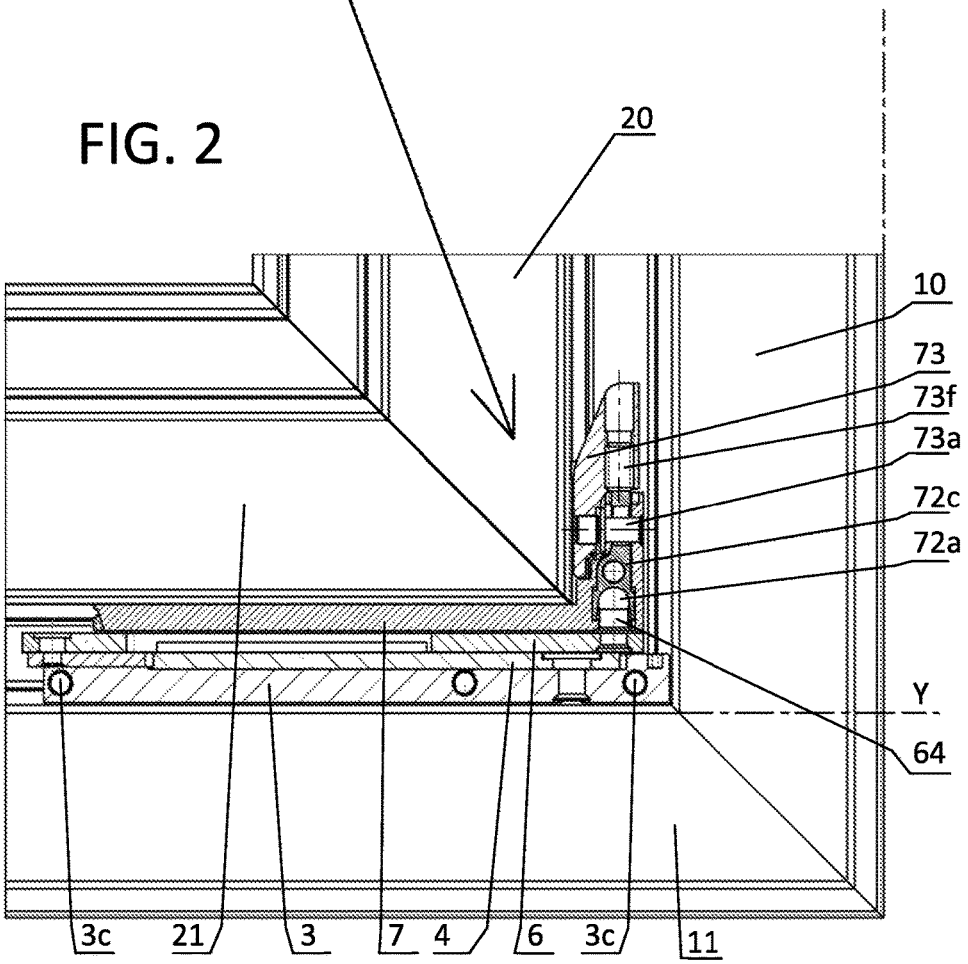

HIDDEN HINGE

CROSS-REFERENCE TO RELATED APPLICATIONS

This application is a 371 of PCT/IB2016/054158, filed Jul. 12, 2016 which claims the benefit of Italian Patent Application No. 102015000034634, filed Jul. 15, 2015.

FIELD OF THE INVENTION

The present invention relates to a hinge for windows having a sash hinged on a fixed frame; in particular, the hinge is of the hidden type, i.e. is mounted inside the jamb of the fixed frame, so that it is not visible when the sash is closed.

BACKGROUND OF THE INVENTION

Different types of hidden hinges are known, but they have several drawbacks.

With reference for example to the hinge described in EP1612356, it does not allow opening of the sash by more than 100-110 degrees (relative obviously to the fixed frame). The same drawback is associated with the hinge described in EP1918498. The limited opening range of the sash constitutes a not minor problem for the manufacturer who, in order to prevent the sash in the fully open position from accidentally closing for example under the action of the wind, must mount an additional stop arm. This results, as may be easily imagined, in considerable complication of the constructional design of the window as well as increased manufacturing costs.

Also known are hinges which allow opening of the sash through 180 degrees with respect to the fixed frame. This is the case for example of the hinges described in the two European patent applications EP2708692 and EP2703587. However, these hinges are constructionally complex and therefore subject to malfunctions and breakages. Moreover they are difficult to assemble and involve not insignificant manufacturing costs.

The hinges described above have a further drawback due to the fact that sliding connections are provided in them. This results in greater friction and therefore more rapid wear, on the one hand, and the need to apply a greater operating force, on the other hand.

Furthermore, the hinges described above do not allow adjustment of the pressure in the direction parallel to the plane of the window itself, namely adjustment of the closing pressure of the perimetral seal of the window.

A further example of the hidden hinge is that described in the publication EP2811092. This hinge allows opening of the sash by up to 180°. However, this hinge is particularly bulky in the direction of the thickness of the window. This bulkiness is considerable and prevents such a hinge from being used on profiles of small-thickness or thin windows such as those which are currently widely used.

SUMMARY OF THE INVENTION

The object of the invention is to provide a hinge of the hidden type which solves the problems of the known hinges and which moreover constitutes a valid constructional alternative thereto.

It is therefore an object of the hinge according to the invention to ensure opening of the sash through 180 degrees, but at the same be constructionally simple and easy to install.

Moreover, yet another object of the hinge according to the invention is to allow also tilted opening of the sash.

A further object of the present invention is to provide a hinge which is both structurally simple and simple to use and easy to assemble and which has relatively low manufacturing costs.

Further objects of the hinge according to the invention is to ensure small dimensions so that it may be installed also on profiles with a small thickness such as those described above and allow also adjustment in a direction parallel to the plane of the window.

These and other objects are achieved by the hidden hinge according to the invention, the main characteristic features of which are defined by claim 1 in the accompanying claims.

Further important characteristic features are also contained in the dependent claims.

BRIEF DESCRIPTION OF THE DRAWINGS

The characteristic features and advantages of the device according to the present invention will emerge more clearly from the following description of embodiments thereof, provided by way of a non-limiting example with reference to the attached drawings in which:

FIG. 1 is a front view of a window with a movable sash partly open relative to a fixed frame;

FIG. 2 shows a cross-sectional view, along a plane defined by the fixed frame, of a first constructional variant of the hinge according to the invention, mounted on the window according to FIG. 1;

DETAILED DESCRIPTION OF THE INVENTION

Figure 3:
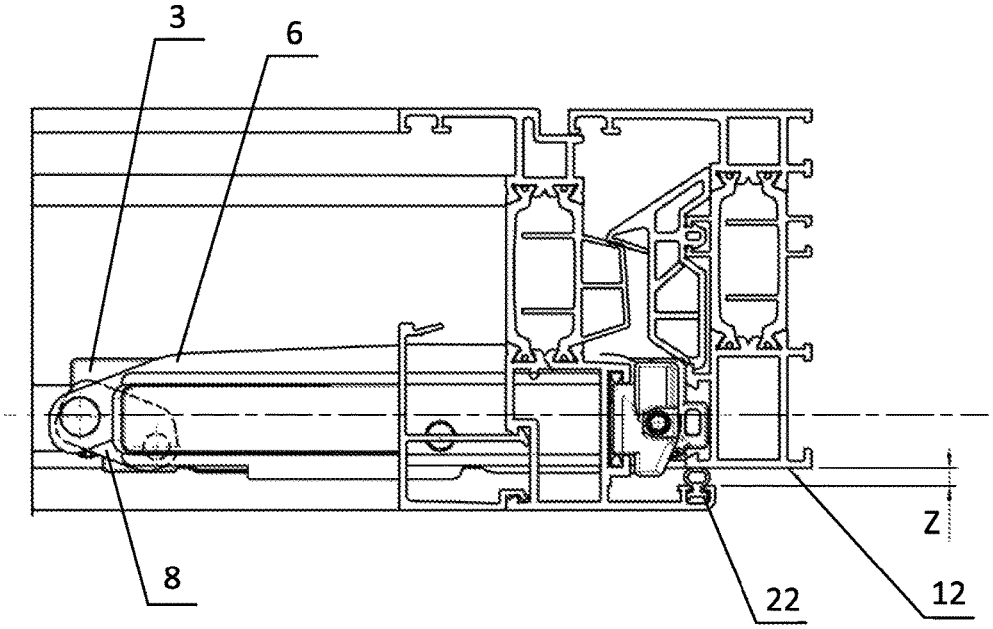
FIGS. 3 to 8 illustrate in plan view operation of the first constructional variant of the hinge according to the invention during successive moments of opening of the movable sash relative to the fixed frame.
Figure 4:
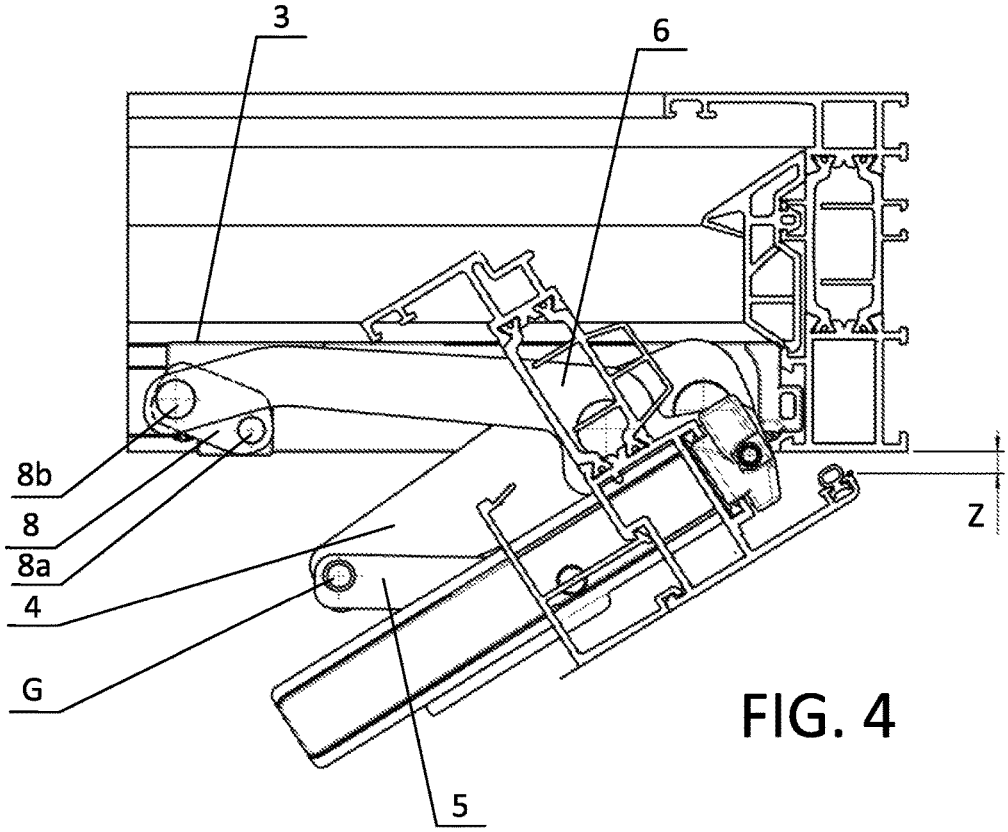

With reference to FIGS. 1 to 10, the window, according to a known configuration, comprises a fixed frame 1 to which a movable sash 2 is rotatably connected. In particular, the movable sash 2 is hingeably mounted on the fixed frame and has an opening/closing movement along a vertical or longitudinal axis X parallel to a vertical hinging upright 10 of the said fixed frame. The fixed frame also has a free vertical upright, opposite to the hinging upright 10, on which closing of the sash is performed by means of known closing systems operated by a handle (not shown).

The fixed frame also comprises two horizontal crosspieces which extend between the aforementioned uprights, i.e. a bottom horizontal crosspiece 11 which defines a horizontal or transverse axis Y, perpendicular to the aforementioned axis X. A third horizontal perpendicular axis Z defines with X and Y a main Cartesian coordinate system.

The sash is hingeably mounted on the fixed frame by means of at least two hinges. In the drawings the hinge according to the invention is shown as a bottom hinge (namely that closest to the ground, during assembly), but it is also quite possible for this hinge to be mounted in an opposite position, for example at the top.

Correspondingly the sash also has two vertical uprights, i.e. a respective vertical hinging upright 20 which corresponds to the vertical upright 10 of the frame and a bottom horizontal crosspiece 21 which corresponds to the horizontal crosspiece 11 of the fixed frame.

Figure 9:
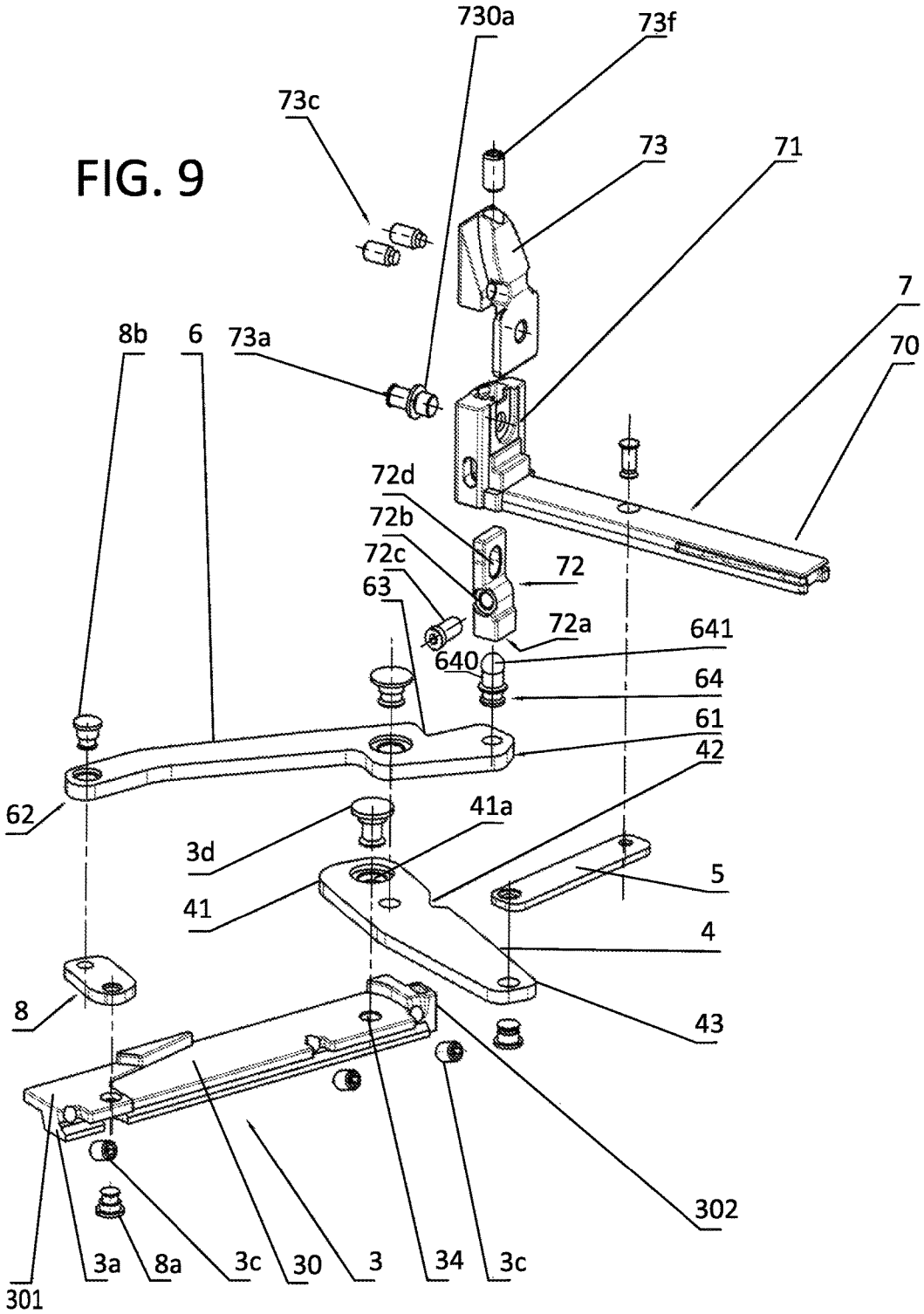
FIG. 9 shows an exploded and isolated view of the first constructional variant of the hinge according to the invention.
Figure 10:
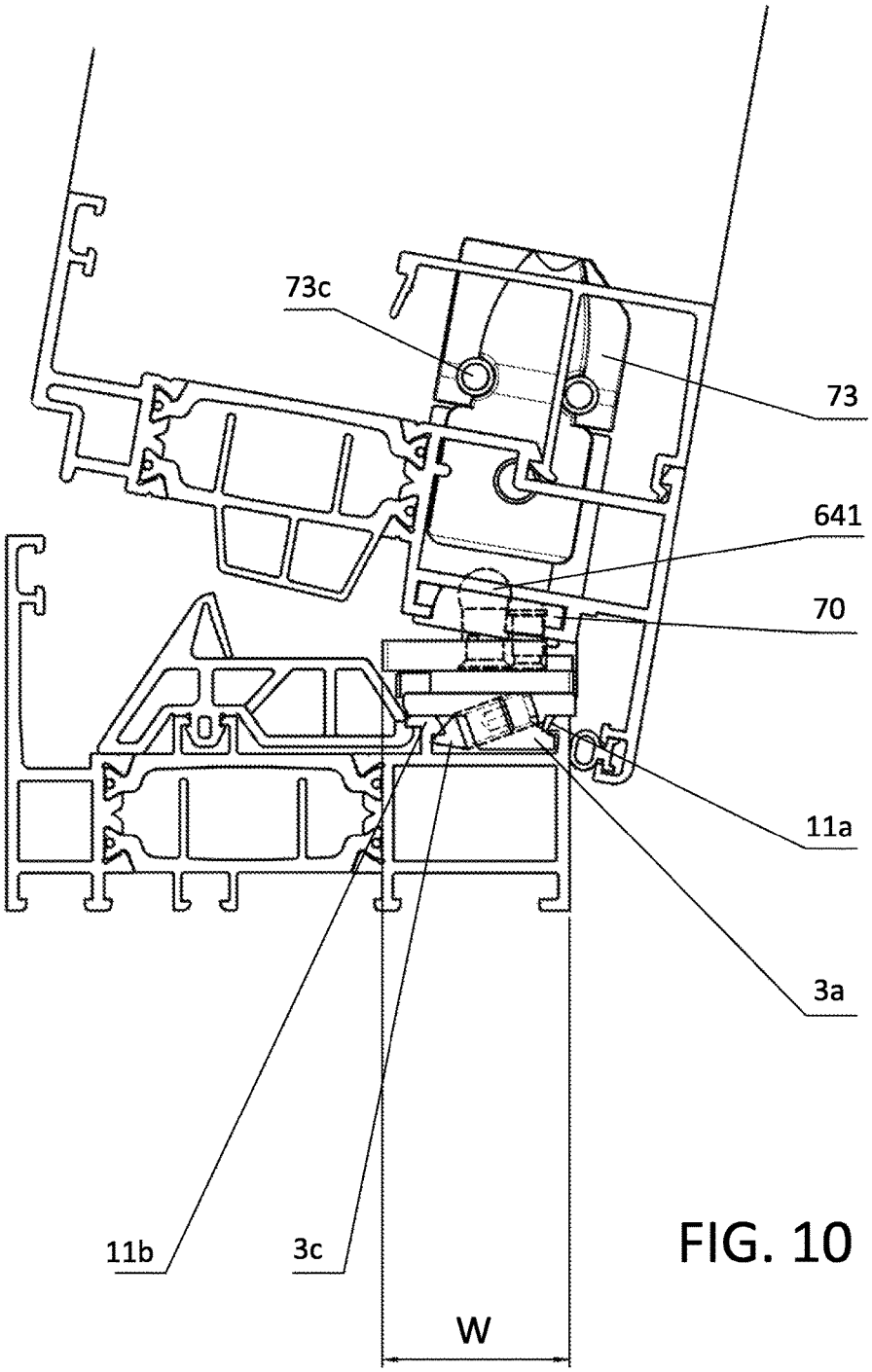
FIG. 10 is a side view of the window on which the first constructional variant of the hinge is installed, this view showing a tilting opening movement of the movable sash relative to the fixed frame.

With particular reference now to FIGS. 2 and 9 a first constructional variant of the hinge according to the invention comprises a first element 3 (or fixed element) which is mounted on the horizontal crosspiece 11 of the fixed frame adjacent to the vertical upright 10 and a second element 7 (or movable element) which is instead basically associated with the horizontal crosspiece 21 and the vertical upright 20 of the movable sash 2. The fixed element 3 and the movable element are connected together by means of a system of levers which will be described further below in detail.

The first element 3 comprises a plate 30 which is fixed to the horizontal crosspiece 11 of the fixed frame so as to be parallel to the ground and aligned with the horizontal axis Y. The plate 30 has at the bottom a shaped part 3*a* for performing fixing to the frame and in particular onto two flanges 11*a* and 11*b* projecting inside a seat formed in the horizontal crosspiece. Fixing of the plate to the crosspiece is improved by means of dowels 3*c*.

Two ends of the plate, i.e. a distal end 301 and proximal end 302 in relation to the vertical upright 10, are provided with holes for respective pins for connection with a first lever and second lever of the hinge.

In detail, the distal end 301 is provided with a hole for a pin 8*a* which performs the rotatable connection with a first lever or toggle 8, which will be described further below.

The second proximal end 302 is instead provided with a hole 34 for rotatable insertion of a second pin 3*d*. The latter performs the rotatable connection F of a second lever 4 on the plate 30 and in this connection the second lever 4 also has, at a first end 41 thereof, a suitable hole 41*a*. When the hinge is mounted, this first end 41 is the proximal end relative to the hinging upright 10.

The second lever 4 is also plate-like and has a substantially rectangular shape. It has, however, on its side, close to the first end 41, a first incision 42, the sides of which form an angle of 90 degrees relative to each other. During assembly the incision 42 is directed towards the hinging upright 10.

At a second end 43, distal from the first end, the lever 4 is rotatably hinged at G with an auxiliary arm 5 which is connected, at its opposite end, to the second element 7 and therefore to the movable sash 2.

Furthermore, opposite the incision 42, the second lever 4 is hinged at H with a third lever 6 which is in turn rotatably connected, by means of a third pin 8*b*, to the lever 8 and in particular to its end opposite the end for connection with the plate 30. This rotatable connection is provided on the distal end 62 of the third lever, namely that which is furthest from the upright 10. At a proximal end 61 relative to the upright, instead, the third lever 6 is rotatably connected to the second element 7. The hinging between the third lever 6 and the second lever 4 is performed between these two ends, in a position closer to the first end 41, 61. In the region of this hinging point a further incision 63 is provided on the third lever 6, said incision, similar to the first incision 42 described above, having sides at right angles to each other. The two incisions have similar dimensions since, during operation of the hinge, they will be arranged superimposed on each other, as will become clear further below.

Considering now the element 7 associated with the movable sash, it has a right-angled form, i.e. has a main body 71 which engages inside a suitable seat formed in the vertical upright 20 of the sash and a flat body or protrusion 70 which is inserted inside a suitable seat formed in the horizontal crosspiece 21 of the movable sash.

The aforementioned hinging together of the auxiliary arm 5 and the movable element 7 is performed on the flat protrusion 70, while the hinging point M with the third lever 6 is performed on the main body.

In detail, said hinging is performed by means of a mushroom-head pin 64 or a pin which has a substantially cylindrical stem 640 for engagement inside a hole formed in the third lever 6 and a mushroom or spherical head 641 which engages inside a suitable seat of the movable element 7.

With this spherical head it is possible to obtain a further degree of freedom, also rotationally about the horizontal axis Y and therefore provide a ball-joint type hinging system. Therefore, with the hinge according to the invention, it is possible not only to open the sash rotationally relative to the frame movable about the vertical axis X, but also to open the sash with a tilting movement about the horizontal axis Y (see FIG. 10).

In even greater detail, the body 71 has a seat inside which a plug 72 is inserted with play. An upper or cover element 73 is mounted on the body 71 so as to define, together with it and the plug, a main assembly of the element 7. The connection of the cover element on this assembly is performed by means of a transverse screw 73*a*. Moreover, the cover element is connected integrally with the vertical upright 20 of the sash by means of two screws 73*c*, since it has flanges which are inserted inside suitable seats formed on the said upright.

The corresponding seat 72*a* for receiving the spherical head 641 is formed inside the plug 72. Moreover, the plug is provided with a transverse threaded hole 72*b* which receives, inserted inside it, a first screw 72*c* arranged transversely, i.e. so as to define an associated axis Y' which, when the sash is open at 90°, corresponds to the transverse axis Y. This screw allows the transverse adjustment of the sash relative to the fixed frame, namely the adjustment along the plane XY of the pressure of the perimetral seal of the window. In particular, the screw 72*c* has a length greater than the width of the plug, but in any case a length such that it may be housed inside the seat of the body 71; therefore, operation of this screw will cause, by means of a pushing force, displacement of the body 71 in the direction of the axis Y' relative to the cover element 73. This displacement results precisely in adjustment of the pressure of the seal exerted by the sash closed on the fixed frame.

Perpendicularly relative the transverse hole 72*b* an eyelet 72*d* is formed for receiving a second screw 73*a* for connecting the plug to the body 71. The screw 73*a* defines an associated axis Z' which, when the sash is open at 90°, corresponds to the axis Z and is therefore arranged perpendicularly relative to the screw 72*c*. The directions X, Y' and Z' therefore define a secondary Cartesian coordinate system which corresponds to the main Cartesian coordinate system when the sash is closed.

Considering again the second screw 73*a*, it has a circular disc element 730*a* which, upon rotation of the screw, pushes the body 71, tending to move it away from the cover element 73 which is fixed to the upright. The relative movement away from each other of body 71 and cover element 73, although minimal, is nevertheless sufficient to produce a transverse adjustment of the window along the plane XY.

Furthermore, a third longitudinal screw or dowel 73*f* is inserted inside the head of the cover element 73. The dowel is inserted longitudinally along the axis X inside the cover element vertically abutting on the plug 72 and is arranged perpendicularly relative to the screws 73*a* and 72*c*. Rotation of the dowel produces the vertical displacement of the plug 72 relative to the cover element 73 and consequently, since the plug is pushed so as to abut against the pin 64, raising of the sash and adjustment thereof along the axis X or in the plane YZ.

Figure 11:
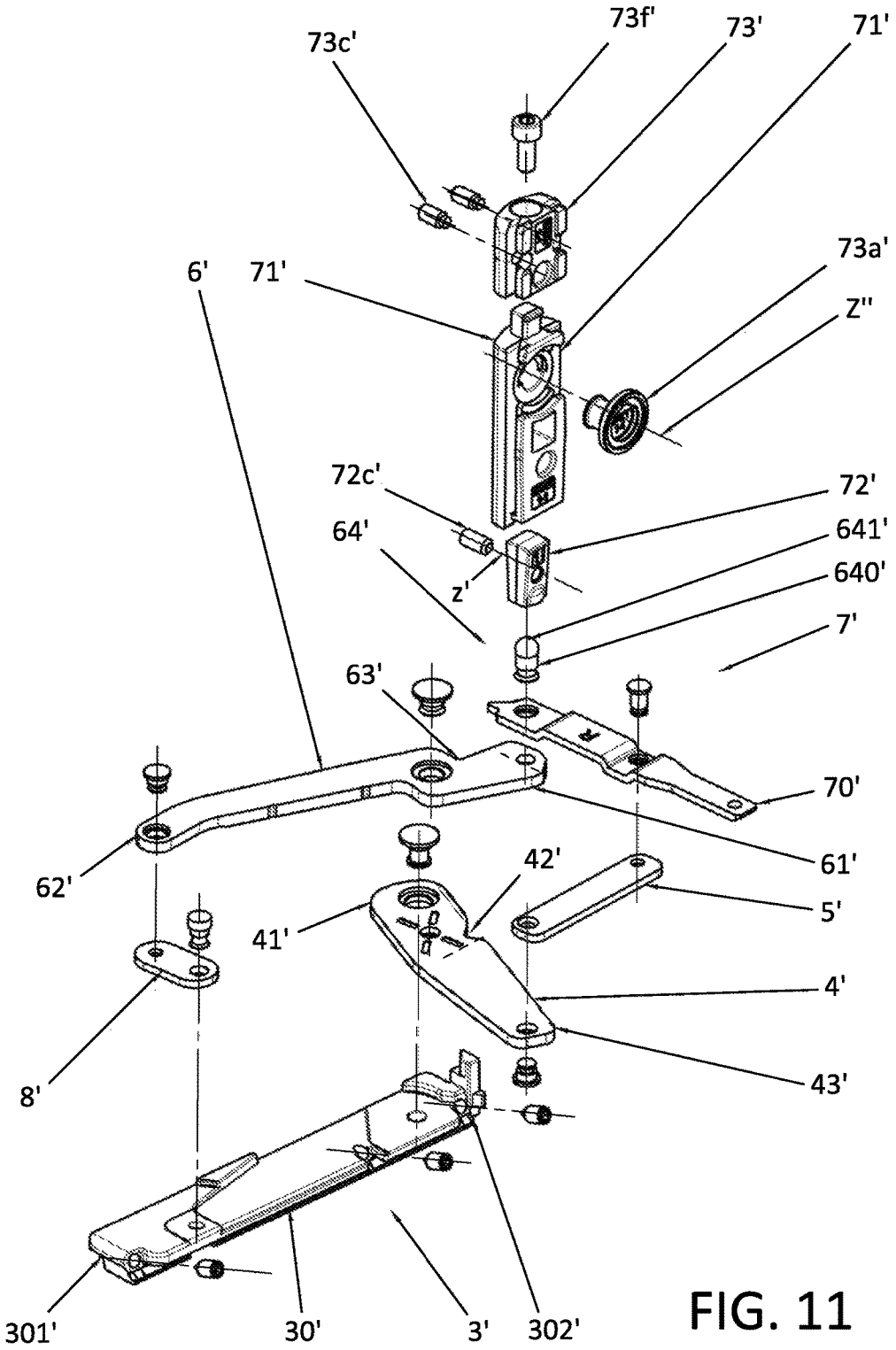
FIG. 11 shows an exploded and isolated view of a second constructional variant of the hinge according to the invention.

With reference now to FIG. 11, a second constructional variant of the hinge according to the invention is described.

This variant differs from the first one essentially as regards the second element 7', the first element 3' and the system of levers 4', 5', 6' and 8' being substantially similar to that of the first constructional variant described above and not described here again.

In greater detail, the second element 7' associated with the movable sash comprises a flat or plate-like body 70' which engages inside the appropriate seat formed in the horizontal crosspiece 21 of the movable sash and a main body or primary plug 71', different from the plate-like body 70' and adapted to be inserted inside the vertical upright 20 of the sash. The primary plug 71' has a seat inside which a secondary plug 72' is inserted with play. Hinging with the third lever 6' is performed inside this secondary plug 72', in a similar manner to the first constructional variant, by means of mushroom-head pin 64'. The connection between flat body 70' and main body 71' is performed by means of engagement of said mushroom-head pin 64' inside said plug 72'.

An upper or cover element 73' is mounted onto the primary plug 71', as shown in the figure. Connection of the cover element 73' onto the primary plug is achieved by means of simple mounting with play, while connection to the vertical upright 20 of the sash is performed by means of two screws 73*c*.

Considering now the adjustments, a first screw 72*c'* is inserted inside the secondary plug, being arranged so as to define an associated axis Z' which, when the sash is open at 90°, corresponds to the axis Z. Compared to the first constructional variant, this screw is arranged at right angles to the transverse adjusting screw 72*c* and in fact, in this case, it allows transverse adjustment of the window along the plane XY, owing to the pushing force exerted by the screw on the secondary plug and therefore on the primary plug which, albeit minimally, causes it to move away from the upper element 73'.

The adjustment of the pressure on the perimetral seal of the window along the plane XZ is obtained by exerting a force on a disc element 73*a'*, the outer diameter of which is such as to enter freely and without play inside the cavity in the upright 20, being arranged along an associated axis Z" which, when the sash is open at 90°, corresponds to the axis Z. The disc element has an eccentric stem and has in its head a suitable seat for a tool so that, upon rotation of the head and therefore the disc element, the relative movement of the primary plug 71' away from the upright and therefore adjustment along the plane XZ is obtained. In fact, owing to the eccentricity of the stem of the disc element, its rotation is converted into a thrust along an associated axis Y' parallel to the axis Y and therefore along an axis perpendicular to the plane XZ.

The third adjustment, namely the adjustment along the axis X, i.e. in the plane YZ, is obtained in a similar manner to the first constructional variant, by rotationally operating a screw 73*f* inserted inside an appropriate seat in the cover element 73'. By operating the dowel the vertical displacement of the primary plug 71' is performed with respect to the cover element 73' and consequently raising of the sash and its adjustment with respect to the plane YZ is obtained.

For the description of operation of the hinge in this second constructional variant FIGS. 3 to 8 may again be referred to, since the operating principle is substantially the same as for the first constructional form which was described with reference to these same figures.

When the sash is closed on the fixed frame (FIG. 3), the second lever 4, 4', the auxiliary arm 5, 5' and the third lever 6, 6' are aligned with each other in a superimposed condition with respect to the plate 30, 30' of the first element and the element 71, 71' of the second element 7, 7' connected to the vertical upright of the sash. The lever 8, 8' is rotated towards the side opposite to the upright 10. In FIG. 3, moreover, "z" denotes the distance between an outermost edge 22 of the movable sash 2 and the outermost flat surface 12 of the upright 10 of the fixed frame 1, said surface defining the plane XY.

By opening the sash through an angle $\alpha$ between 0 and 40 degrees with respect to the plane XY, the auxiliary arm 5, 5' causes the movement of the second lever 4, 4' which rotates with respect to the hinging point F. As a result of this movement, the third lever 6, 6' rotates about the hinging point H and consequently causes the rotation of the lever 8, 8'. The rotation of the latter causes an increase in the rotation of the lever 6, 6'.

This rotation of the third lever results in a roto-translation of the hinging point M with respect to the fixed frame. In fact, the point of pure rotation H of the third lever is integral with the second lever and therefore varies its position in space depending on the rotation of the second lever 4, 4' with respect to F. The roto-translational movement of the point M is such that the rotation of the sash with respect to X does not cause a reduction in the distance z which, on the contrary, remains constant.

Figure 5:
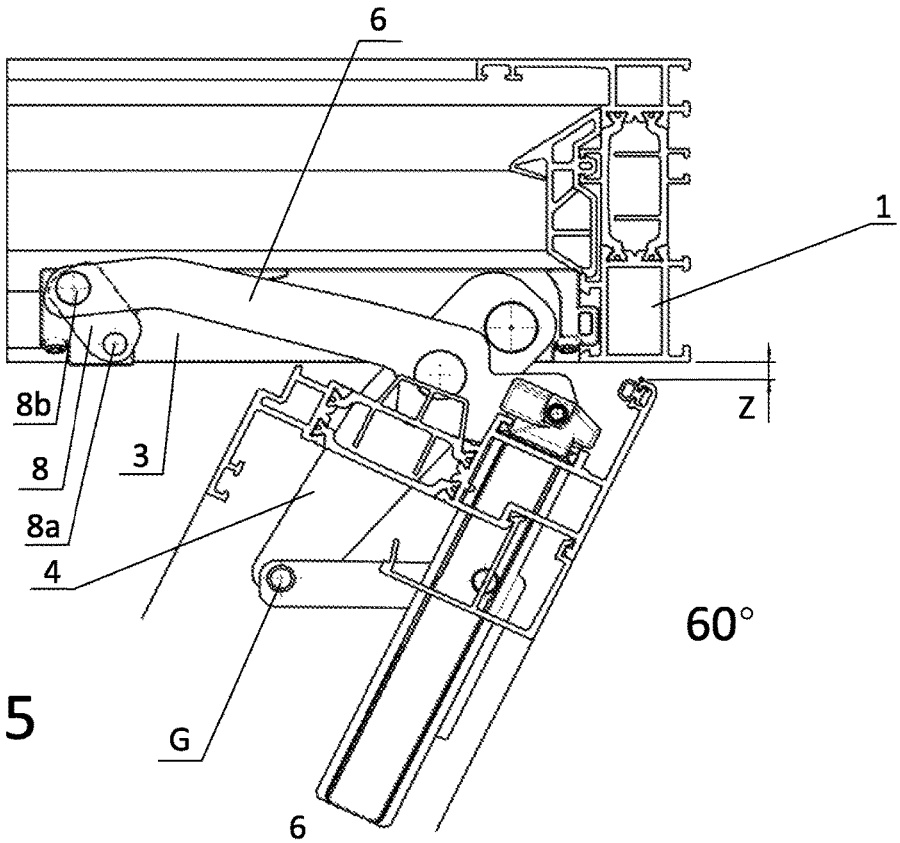
Figure 6:
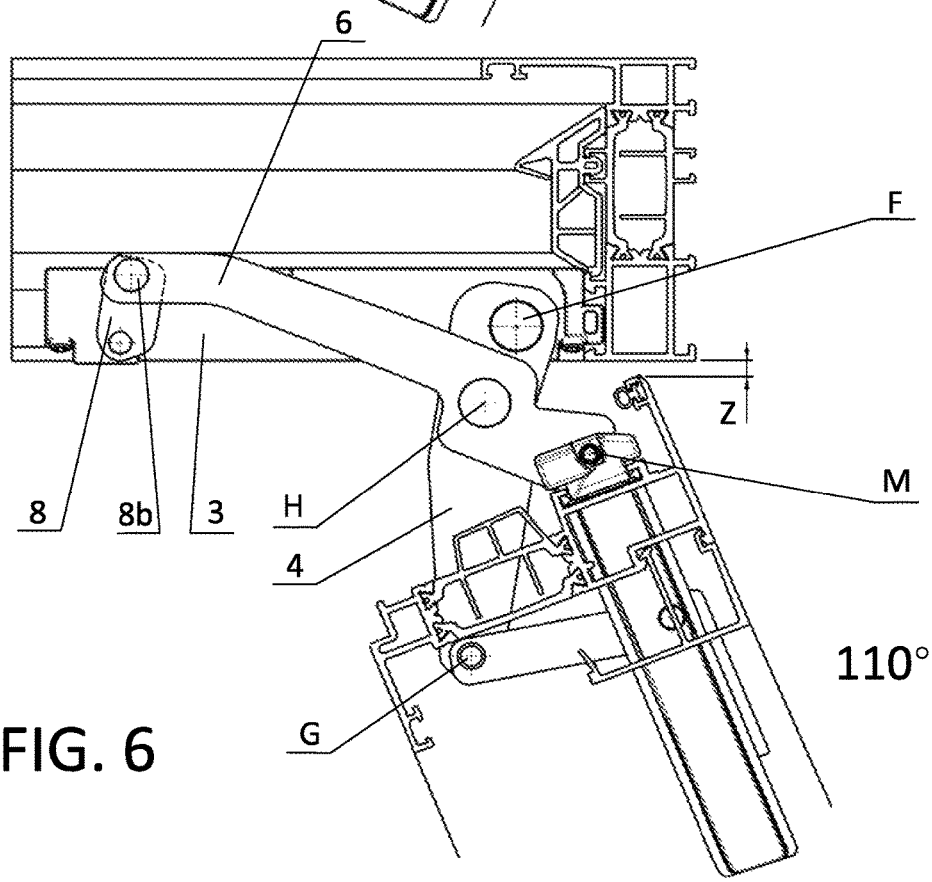

With reference now to FIG. 5, when opening the sash by about 30 to 60 degrees, the further rotation of the second lever 4, 4' also causes rotation of the third lever 6, 6' and consequently the lever 8, 8' which therefore causes a further rotation of the third lever. This translation corresponds to a further roto-translational movement of the hinging point F which compensates for the opening movement of the sash, allowing the distance z to remain constant. FIG. 6 shows the sash open by about 100 degrees. With this opening angle, the lever 8, 8' is located in a position more or less perpendicular with respect to the third lever 6, 6' and therefore in the position where there is a maximum increase of rotation.

Figure 7:
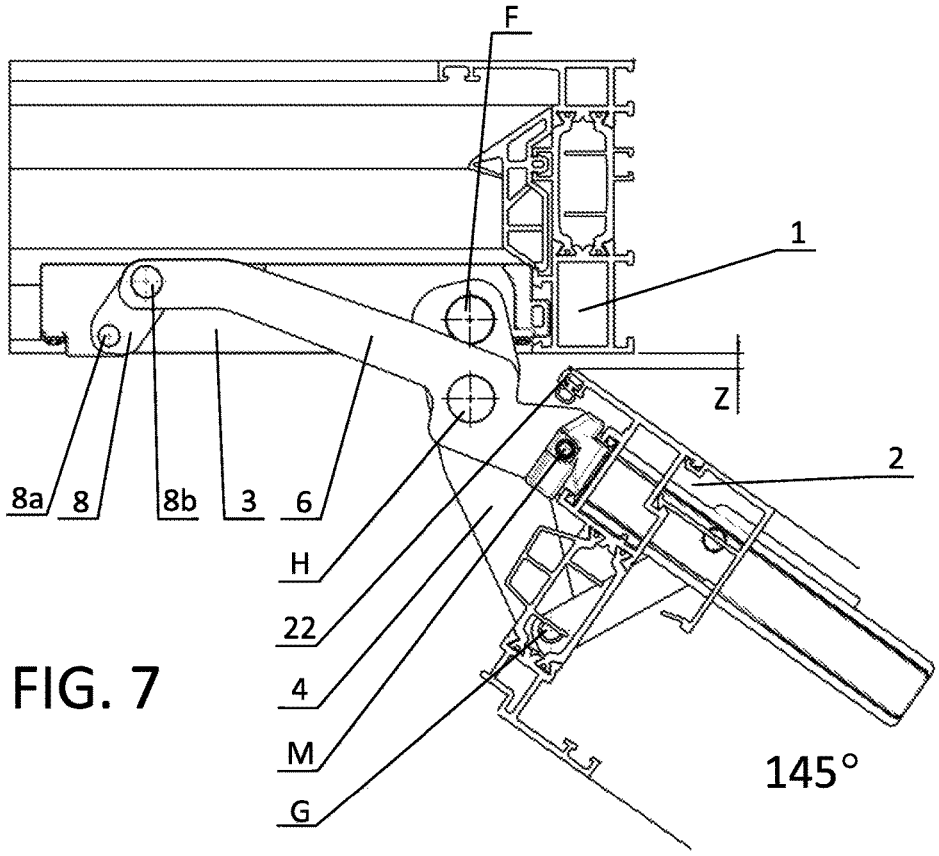
Figure 8:
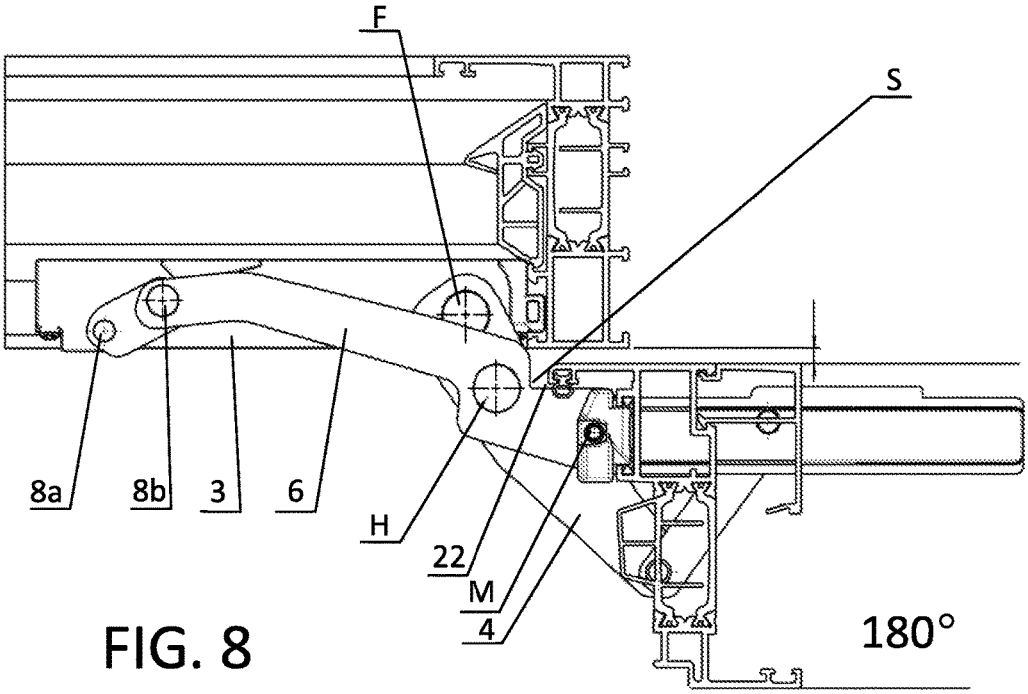

FIGS. 7 and 8 show instead opening of the sash through 100 to 180 degrees. The lever 6, 6', by bringing about a further rotation of the lever 8, 8', causes a reduction in the rotation of the third lever. This movement results in a roto-translational movement of the sash and therefore the distance z remains unvaried, allowing total opening of the sash.

The constant value of the distance z during all the opening phases is therefore due to the fact that the lever 8, 8' compensates for and corrects rotation of the third lever 6, 6'. More specifically in the closed window position (FIG. 3) the lever is inclined with respect to the plane XY at an angle of between 20 and 30 degrees. During opening of the sash the lever rotates relative to the plane XY and consequently moves away from it the position of the connecting pin 8*b*, 8*b'*, increasing the rotation of the lever 6, 6'. On the other hand, once the degree of angulation of the sash of about 100 degrees is exceeded (value at which the lever 8, 8' is at right angles to the plane XY) the angulation of the lever with respect to the plane XY diminishes again and the connection lever 8*b*, 8*b*' moves back again towards the plane XY and this results in a reduction of the lever 6, 6'.

Furthermore, when the sash is opened through more than 100 degrees, the two incisions 42, 42' and 63, 63' start to move over each other until they are completely superimposed, this being achieved when the sash is at 180 degrees with respect to the fixed frame. In this position the sides of the incisions (which, as mentioned above, are mutually arranged at right angles) are directed respectively parallel and perpendicular to the flat surface 12 of the fixed frame so as to define therewith a recess S inside which the external edge 22 of the sash 2 is received. The presence of the incisions therefore allows total opening of the sash because otherwise, during opening beyond 100 degrees, the external edge 22 of the sash would strike against the system of levers.

The hinge according to the invention therefore achieves all the predefined advantages. In particular it allows complete opening of the sash and moreover also allows the tilted opening of the sash owing to the ball-joint type connection M.

Moreover, as described above, the distance z remains constant during the whole of sash opening. If this distance were smaller there could be the risk that the sash might strike the fixed frame and therefore not only would complete opening of the sash be prevented, but this would also cause damage to the fixed frame. If instead this distance were greater there would be sufficient space for users to insert, accidentally between sash and window, their fingers which could be crushed when the window is closed.

Furthermore, the hinge is particularly simple to assemble; in fact it is mounted entirely on the fixed frame and the movable sash is then inserted, with the hinge already assembled, by means of simple engagement of the body 71 and the upper element or cover element 73 inside a suitable seat present on the upright of the sash. In order to favour and stabilize engagement the body 73 has special engaging flanges. As a result assembly of the window as a whole is made much faster and easier.

The hinge is moreover particularly suitable for being mounted on windows made with small-size profiles such as those described above. In fact, the adjustment system described above is particularly compact and is provided only on the element fixed to the movable sash, leaving free the crosspiece of the fixed frame which may therefore be used for the extension of the leverage system. The system of levers, which is therefore arranged superimposed on the crosspiece of the fixed frame, does not occupy a portion of space outside of the window and the hinge as a whole is therefore particularly compact and occupies little space even when the sash is fully open.

Furthermore, the hinge allows three adjustments of the sash with respect to the fixed frame, relative to the planes XY, XZ and YZ. These adjustments are performed with the hinge installed and are simple to carry out owing to the constructional design of the plug, as described above.

The hinge according to the invention is also particularly resistant to wear during use and provides the user with a sense of ease and linearity during rotation, since there are no sliding connections.

The second constructional variant of the hinge according to the invention is even more advantageous from the point of view of ease of assembly since the body 70' is provided, during assembly, already mounted on the pin 64'.

The present invention has been described hitherto with reference to preferred embodiments thereof. It is to be understood that other embodiments relating to the same inventive idea may exist, all of these falling within the scope of protection of the claims which are attached below.

The invention claimed is:

1. A hinge for the pivotal connection a movable sash to a fixed frame of a window, said fixed frame and said sash comprising respectively a vertical upright defining a vertical rotation axis (X) of said sash with respect to said frame and a horizontal crosspiece defining a horizontal axis (Y) perpendicular to said rotation axis (X), said axes defining with a third perpendicular horizontal axis (Z) a main Cartesian coordinate system and three consequent planes, horizontal plane (YZ), first vertical plane (XZ) and second vertical plane (XY), said hinge comprising:

a first element adapted to be connected to said fixed frame and a second element adapted to be connected to said movable sash;

a system of levers hinged with each other, which connects said first element to said second element so as to obtain at least a roto-translational movement of said second element with respect to said first element and, consequently, of said sash with respect to said fixed frame;

wherein said second element comprises a plug pivotally connected to said system of levers, a main body defining a seat housing with play said plug, and a cover element which engages with play on said body and is integrally fixed to said vertical upright, adjusting means also being provided for adjustment of the relative position of said sash and said fixed frame, said adjusting means exerting during operation a pushing force respectively on said plug, on said body and on said cover element in three directions (X, Y', Z') defining a secondary Cartesian coordinate system, one of said directions being defined by said rotation axis (X), said secondary Cartesian coordinate system corresponding, in the closed position of the sash, to said main Cartesian coordinate system, so that these pushing movements performed by said adjusting means in said three directions cause an adjustment of the distance of said sash from said fixed frame with respect to said second vertical plane (XY), said horizontal plane (YZ) and said first vertical plane (XZ).

2. The hinge according to claim 1, wherein said first element comprises a plate integrally mounted on a crosspiece of said fixed frame, said system of levers being hinged at both ends of said plate, a distal end and a proximal end in relation to said vertical upright, said system of levers extending therefore along the whole length of said plate.

3. The hinge according to claim 2, wherein said system of levers comprises a first lever pivotally connected to said plate at said distal end, a second lever pivotally connected with a first end to said proximal end of said plate, a third lever pivotally connected to said first lever and to said second lever, an auxiliary arm pivotally connected to said second element and to a second end of said second lever, said pivotal connection between said third lever and said second lever being at an intermediate point between said first end and second end.

4. The hinge according to claim 3, wherein said third lever comprises two ends, a distal end for the pivotal connection with said first lever and a proximal end pivotally connected to said plug of said second element.

5. The hinge according to claim 4, wherein the pivotal connection between said second lever and said third lever is at an intermediate point of said third lever between said distal end and proximal end.

6. The hinge according to claim 4, wherein the pivotal connection between said third lever and said plug is obtained by means of a ball joint connection so as to allow opening of said sash about said horizontal axis (Y) with a tilting movement.

7. The hinge according to claim 6, wherein said ball joint connection is obtained by means of a pin which has a stem for engagement with said second lever and a substantially spherical head for pivotal engagement with said plug.

8. The hinge according to claim 3, wherein notches are formed on respective sides of said second lever and said third lever, said notches being such that they are superimposed when said sash is open at 180° with respect to said fixed frame so as to define with a flat surface of said fixed frame arranged along said second vertical plane (XY) a recess (S) for receiving a projecting external edge of said sash.

9. The hinge according to claim 8, wherein, during said roto-translational movement of said sash with respect to said fixed frame, a distance (z) between said flat surface of said fixed frame and said external edge of said movable sash remains constant.

10. The hinge according to claim 1, wherein said second element comprises a flat body which is arranged on a horizontal crosspiece of said sash, said main body extending perpendicularly from said flat body.

11. The hinge according to claim 1, wherein said adjusting means comprise a first screw having an axis (Y') representing a horizontal axis (Y') of said secondary coordinate system, said screw engaging in said plug, so that, upon rotation of said first screw, it exerts a pushing force on said body along said axis (Y') and causes the relative displacement thereof with respect to the cover element, this movement resulting in an adjustment of the distance of the sash with respect to the fixed frame in the first vertical plane (XZ).

12. The hinge according to claim 11, wherein said adjusting means comprise a second screw for the connection of said plug to said body, said second screw being arranged perpendicular to said first screw along a second horizontal axis (Z') of said secondary Cartesian coordinate system, so that, upon rotation of said second screw, it exerts a pushing force on said body, causing the relative displacement thereof along said second horizontal axis (Z') with respect to said cover element and performing adjustment of the distance between sash and fixed frame with respect to the second vertical plane (XY).

13. The hinge according to claim 12, wherein said adjusting means comprise a third screw arranged along said vertical axis (X) and perpendicular to said first screw and second screw, defining also a vertical axis (X) of said secondary Cartesian coordinate system, said third screw engaging on said cover element and abutting on said body, so that, upon rotation of said third screw, it exerts a pushing force on said body, causing the relative displacement thereof and therefore adjustment of the distance between said sash and said fixed frame with respect to said horizontal plane (YZ).

14. The hinge according to claim 1, wherein said second element comprises a flat body which is arranged on a horizontal crosspiece of said sash and said main body adapted to be connected to said vertical upright of said sash and to said flat body.

15. The hinge according to claim 1, wherein said adjusting means comprise a first screw arranged along a second horizontal axis (Z') of said secondary Cartesian coordinate system, so that, upon rotation of said first screw, it exerts a pushing force on said plug, causing the relative displacement thereof along said second horizontal axis (Z') with respect to said main body and performing adjustment of a distance between sash and fixed frame with respect to the second vertical plane (XY).

16. The hinge according to claim 15, wherein said adjusting means comprise a disc element with a stem arranged along an associated axis (Z") eccentric with respect to this associated axis, so that, upon rotation of said disc element, it exerts a pushing action along an axis (Y') parallel to said axis (Y) on said body, causing the relative displacement thereof with respect to the cover element, said movement resulting in adjustment of the distance of the sash with respect to the fixed frame in the first vertical plane (XZ).

17. The hinge according to claim 16, wherein said adjusting means comprise a third screw arranged along an axis (X) of said secondary Cartesian coordinate system, said third screw engaging in said upper element and abutting on said body, so that, upon rotation of said third screw, it exerts a pushing force on said body, resulting in the relative movement thereof and therefore adjustment of the distance between said sash and said fixed frame with respect to said horizontal plane (YZ).

* * * * *